US005777644A

United States Patent [19]

Yamaguchi et al.

[11] Patent Number: 5,777,644

[45] Date of Patent: Jul. 7, 1998

[54] INK JET RECORDING APPARATUS AND RECORDING METHOD FOR USING INK WALLS IN DISCHARGING INK

[75] Inventors: Takashi Yamaguchi; Tadayoshi Ohno; Shinichi Itoh; Hisatoshi Tanaka, all of Kanagawa-ken, Japan

[73] Assignee: Kabushiki Kaisha Toshiba, Kawasaki, Japan

[21] Appl. No.: 414,094

[22] Filed: Mar. 31, 1995

[30] Foreign Application Priority Data

Mar. 31, 1994 [JP] Japan ..... 6-085550

[51] Int. Cl.[6] ..... B41J 2/045

[52] U.S. Cl. ..... 347/68; 347/44; 347/47

[58] Field of Search ..... 347/44, 48, 54, 347/55, 68

[56] References Cited

U.S. PATENT DOCUMENTS

| | | | |
|---|---|---|---|
| 4,717,926 | 1/1988 | Hotomi | 347/55 |
| 4,746,928 | 5/1988 | Yamada et al. | 347/75 |
| 4,799,068 | 1/1989 | Saito et al. | 347/55 |
| 4,928,125 | 5/1990 | Iino | 347/54 |

FOREIGN PATENT DOCUMENTS

| | | | |
|---|---|---|---|
| 54-12838 | 1/1979 | Japan | 347/48 |
| 57-75866 | 5/1982 | Japan . | |
| 61-189946 | 8/1986 | Japan | 347/54 |
| 6482964 | 3/1989 | Japan | 347/54 |
| 245150 | 2/1990 | Japan | 347/54 |
| 2-74386 | 3/1990 | Japan . | |

*Primary Examiner*—Benjamin R. Fuller
*Assistant Examiner*—Charlene Dickens
*Attorney, Agent, or Firm*—Cushman Darby & Cushman IP Group of Pillsbury Madison & Sutro LLP

[57] ABSTRACT

An ink jet recording apparatus that includes ink with including fine particles and the apparent viscosity being changeable apparently by receiving an electric field, and a voltage applying unit for forming the electric field to make the ink walls. The ink walls are formed by lining up the fine particles in the ink. The ink walls make ink flow channels to flow and discharge ink to form image on a recording medium based on the recording information.

15 Claims, 13 Drawing Sheets

INK JET RECORDING APPARATUS AND RECORDING METHOD FOR USING INK WALLS IN DISCHARGING INK

BACKGROUND OF THE INVENTION

1. Field of the Invention

The present invention relates to an ink jet recording apparatus and its recording method which are used for ink jet printers and the like.

2. Description of the Related Art

In the field of low priced and small sized printers, serial ink jet type printers have been widely used recently. In this type of ink jet printer, an ink jet head travels along the width direction of the paper and paper is fed each time after a line is recorded. The ink jet system is beneficial because it permits downsizing of the printer, fast pixel forming speed, low running cost, etc. On the other hand, it has disadvantages such as printing becoming unstable due to clogging of the ink jet head and is unsuitable for recording pixel concentration in multiple gradations and the like. In particular, the clogging of the ink jet head is important and has been regarded as the principal factor for delaying practical use of the ink jet type recording system over other recording systems.

In the Japanese Patent Disclosure (Kokai) No. 02-74386 (Mar. 14, 1990, by Ebi, Murakami and Nagai), an ink jet recording system employing an ink jet port that was formed in a slit shape relatively larger than a conventional nozzle hole was disclosed. That is, this method forms characters, figures, etc. on a recording medium by jetting drops of ink out of a nozzle having a discharging port in the slit shape opening. On the inner surface of the nozzle, there are multiple electrodes arranged opposing to each other and extending up to the discharging port. The pressure of ink supplied to the inside of the nozzle is increased and the electric field of voltage applied to all the electrodes is removed based on image signals; ink is discharged from the point where no electric field is present.

However, in the ink jet recording system disclosed in the Japanese Patent Disclosure No. 02-74386, the pressure applied to ink is dispersed and the pressure applied to every drop of ink differs depending on the number of drops of ink to be discharged. That is, for instance, the pressure applied to one drop of ink-when 10 drops of ink are to be discharged differs from the pressure applied to one drop of ink when 30 drips of ink are to be discharged. Therefore, there was a problem because the volume of ink to adhere on a recording medium varied depending on the image to be formed and, as a result, it was not feasible to form a high quality image.

SUMMARY OF THE INVENTION

It is an object of the present invention to provide an ink jet recording apparatus and method to form an image of high quality by making discharging pressure applied to each drop of ink uniform.

The present invention provides an ink jet recording apparatus comprising means for forming a plurality of ink walls in ink by applying an electric field to the ink, including fine particles to cause the fine particles to line up, and means for discharging the ink between the ink walls when the ink walls are formed by the ink wall forming means.

Further, the present invention provides an ink jet recording method comprising the steps of applying a voltage to form a plurality of electric fields between multiple electrode pairs arranged in an ink chamber containing ink, the ink having an apparent viscosity which may be changed by receiving the electric field; forming ink walls between the respective electrode pairs in response to the electric field by increasing apparent viscosity of the ink, thus forming multiple ink flow channels through which ink flows; and selectively discharging the ink from the ink flow channels to the outside of the ink chamber based on recording information.

BRIEF DESCRIPTION OF THE INVENTION

DETAILED DESCRIPTION OF THE PREFERRED EMBODIMENT

Hereinafter, an ink jet recording apparatus involved in a preferred embodiment of the present invention will be described with reference to the drawings.

Figure 1:
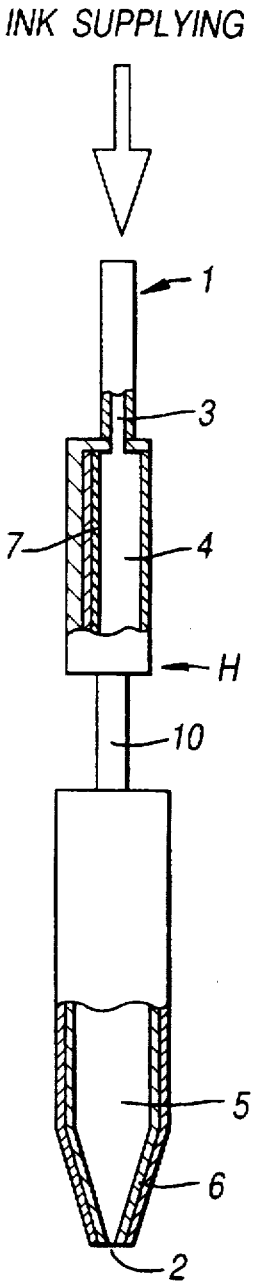
FIG. 1 is a side view of a partially cutaway recording head involved in an embodiment of the present invention.

The structure of the ink jet type recording head involved in the preferred embodiment of the present invention is schematically shown in FIG. 1. The recording head shown in FIG. 1 is capable of simultaneously recording multiple pixels equivalent to one line by a single head as described later in detail.

Figure 2:
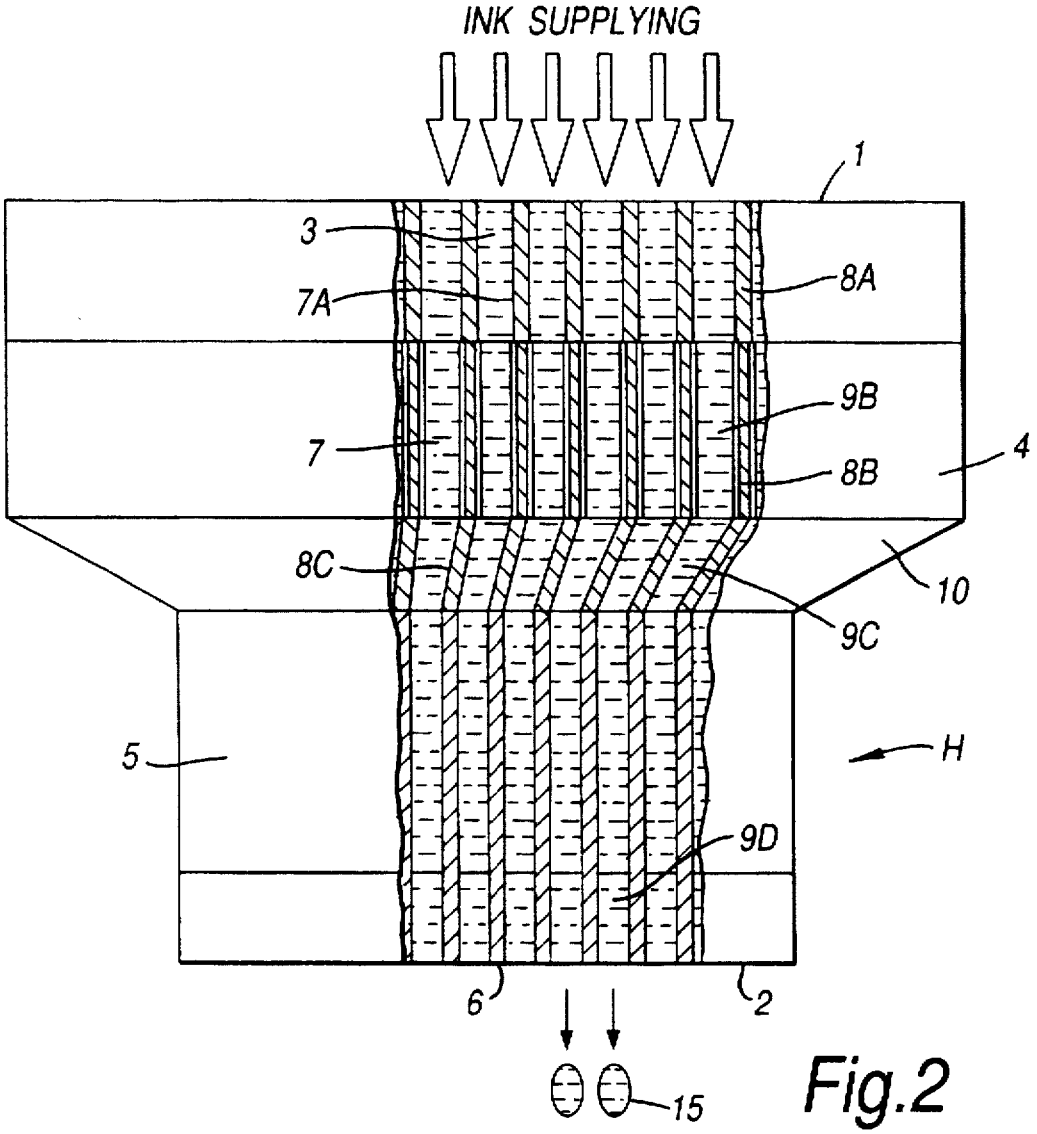
FIG. 2 is a plan view of the partially cutaway recording head shown in FIG. 1.
Figure 3:
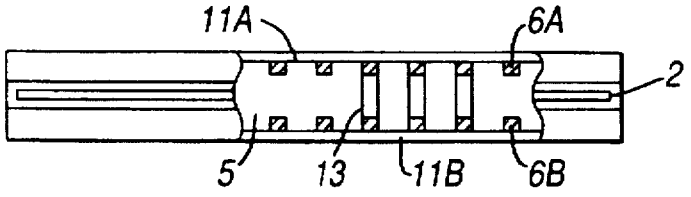
FIG. 3 is a front view of the partially cutaway recording head shown in FIG. 1.

The recording head is comprised of an ink supply port 1 formed at one end and an ink discharging port 2 formed at the other end. Ink is supplied through the ink supply port 1 (viscosity=μ 1, where μ 1 is the viscosity of the ink when no voltage is applied to the ink, such as μ 1=8 $dP_{axs}$) and drops of the ink are jetted out of the ink discharging port 2. A housing H of the recording head is formed in a flat plate shape extended in the direction of one line as shown in FIGS. 2 and 3. In the housing H, there are first channels 3 passing through the supplied ink flows along the ink supply path, a record driving unit 4 that applies discharging pressure to the ink, a second channels 10 passing through the pressurized ink flows and a fluid chamber 5 where the ink is accumulated and drops of ink to be discharged are segregated.

In the fluid chamber 5, control electrodes 6 are provided for controlling discharge of ink based on the Electro-Rheological (ER) effect that will be explained later. The control electrodes 6 are arranged along the direction of one line at intervals corresponding to pixel pitches as shown in FIG. 3. Further, the record driving unit 4 is provided with a piezoelectric element 7 that applies discharging pressure to the ink. The inside of the head, that is, the inside of the housing H, is filled with ink and the discharging port 2 at the end of the head never leaks ink because the surface tension of the ink is balanced with atmospheric pressure.

As shown in FIG. 2, the inside of each of the first channels 3 are divided by multiple passage walls 8A and multiple channels 9A are formed. These channels 9A are provided corresponding to the number of recording pixels of the recording head. As the recording head involved in this embodiment of the present invention is of the eight pixel head type, eight channels 9A are formed. In addition, multiple passage walls 8B are formed extending from the passage walls 8A in the record driving unit 4. Multiple channels 9B which are connected with the channels 9A are formed by the passage walls 8B. A piezoelectric element 7 is provided in each of the channels 9B. Further, the inside of each of second channels 10 are divided into multiple channels 9C which are connected with the channels 9B by multiple passage walls 8C extending from the passage walls 8B.

The fluid chamber 5 has a common space that has not been divided by the passage walls as shown in FIG. 3. However, control electrodes 6A and 6B are provided for dividing the spaces to form multiple channels 9D using the ER effect as described later. That is, these control electrodes 6A and 6B are arranged on flat plates 11A and 11B extending from the passage walls 8C and opposing each other. Thus, on the front of the recording head, the slit shape discharging port 2 comprises two flat plates 11A and 11B as shown in FIG. 3, and the inside of the fluid chamber 5 is filled with ink. The multiple paired electrodes 6A and 6B are arranged along the longitudinal direction of the discharging port 2. That is, the multiple paired electrodes 6A and 6B are arranged along a direction perpendicular to the ink discharge direction.

Further, as one channel 9D is defined by two sets of the control electrodes 6A and 6B, a pair of the control electrodes 6A and 6B are arranged at both ends of the recording head, respectively, that is, total 9(=8+1) sets of the control electrodes 6A and 6B are arranged in this recording head.

The recording head shown in FIG. 1 uses ink using the Electro-Rheological (ER) effect for recording such images as characters and the like. This ink is comprised of an insulating oily fluid as a dispersion medium with very fine powder, such as carbon black, dispersed in about 20% (volume ratio). Kerosene, silicon oil, cyclohexane and the like may be used as a dispersion medium, but almost all insulating fluids can be used as a dispersion medium. In addition, ER fluids colored by dyes may be used. Further, carbon particle based ER fluids with carbon nature produced on the surface of fine particles of resin by heat processing, such a resin as vinyl chloride, epoxy, polystyrene, polyvinyl acetate and the like, may be used. Also, ER fluid in triple layers structure comprising polystyrene as particle nuclei with such materials as metals, organic conductors, carbon, polyacetylene adhered and the outermost surfaces coated with such insulators as vinyl chloride, silica and the like can be used. Furthermore, ER fluid of polyoxyalkylene chain particles may be used as dispersion particle relative to ion exchange resin.

Figure 4A:
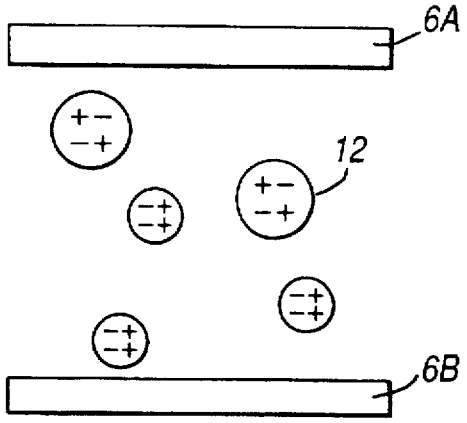
FIG. 4 is an explanatory drawing showing the principle of operation of the recording head shown in FIG. 1.
Figure 4B:
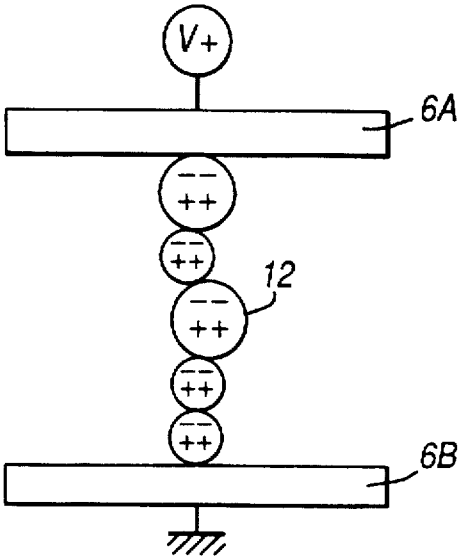
Figure 5:
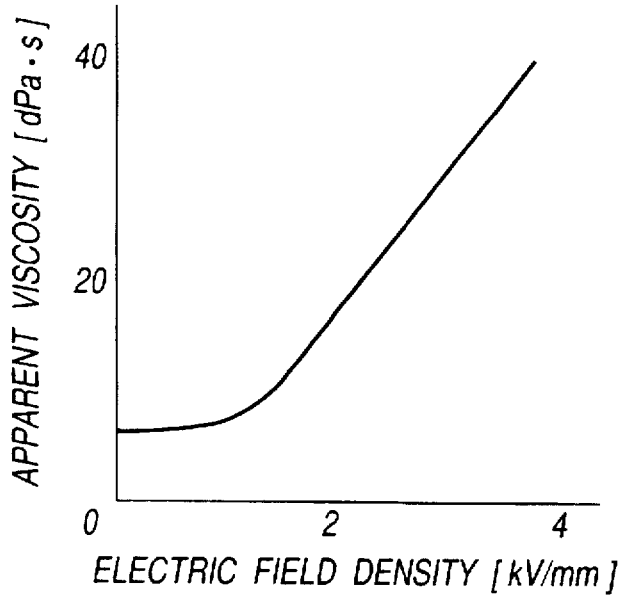
FIG. 5 is a graph showing the viscosity characteristic of ink used for the recording head against voltage.

Fine particles 12 dispersed in the electric viscous fluid between the control electrodes 6A and 6B that are opposing each other, as shown in FIG. 4A, are polarized by the electric field generated between the electrodes 6A and 6B when voltage is applied as shown in FIG. 4B. As a result of this polarization, a force to attract each other is generated in the particles, and the particles are lined up in a chain like shape between the electrodes 6A and 6B. The apparent viscosity of the fluid appears to increase as this particle chain impedes the flow of the fluid. This is called the ER Effect (Winslow Effect). The relationship between electric field intensity and apparent viscosity is shown in FIG. 5. As clearly seen from the graph shown in FIG. 5, viscosity does not change much up to the electric field intensity 0–0.7 kV/mm, but viscosity increases in proportion to the electric field intensity when the electric field intensity increases to above 0.7 kV/mm.

Figure 6:
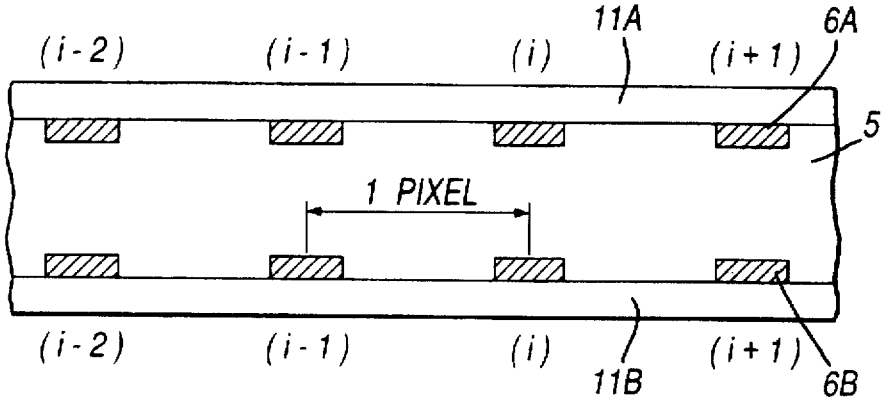
FIG. 6 is a cross-sectional view showing the outline of the arrangement of control electrodes in the recording head shown in FIG. 1.
Figure 7:
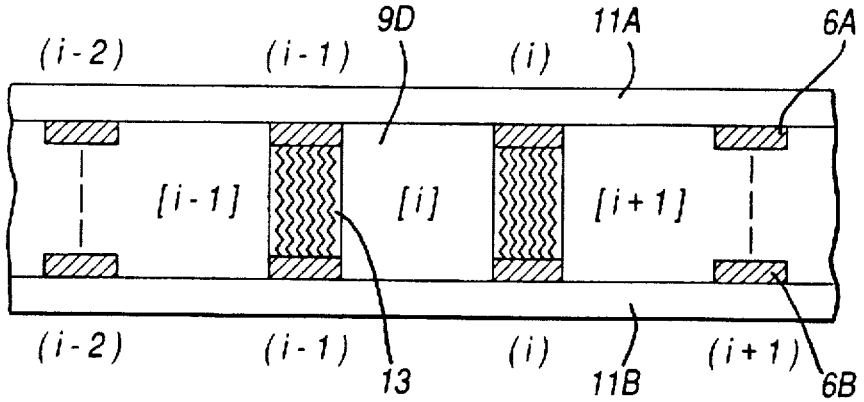
FIG. 7 is a cross-sectional view of the recording head showing the outline of ink walls formed by the control electrodes shown in FIG. 6 and channels defined by the ink walls.

In the recording head of the present invention, channel formation in the recording head is controlled using the ER effect. That is, as no voltage is being applied to the electrodes when the recording is not executed, the partitions (i.e., the passage walls) are not formed in the fluid chamber as shown in FIG. 6. Therefore, ink is freely movable in the fluid chamber 5. On the other hand, when voltage is applied to one set of the control electrodes 6A and 6B which are opposing each other, the viscosity of the ink between these electrodes increases and a wall surface 13 is substantially formed by the ink. Here, if voltage is applied to two adjacent sets of the control electrodes 6A and 6B, one channel 9D is substantially formed by two wall surfaces 13 that are formed by the ink itself as shown in FIG. 7. As shown in FIG. 6, adjacent control paired electrodes are arranged through a space corresponding to a size of one pixel.

Figure 8:
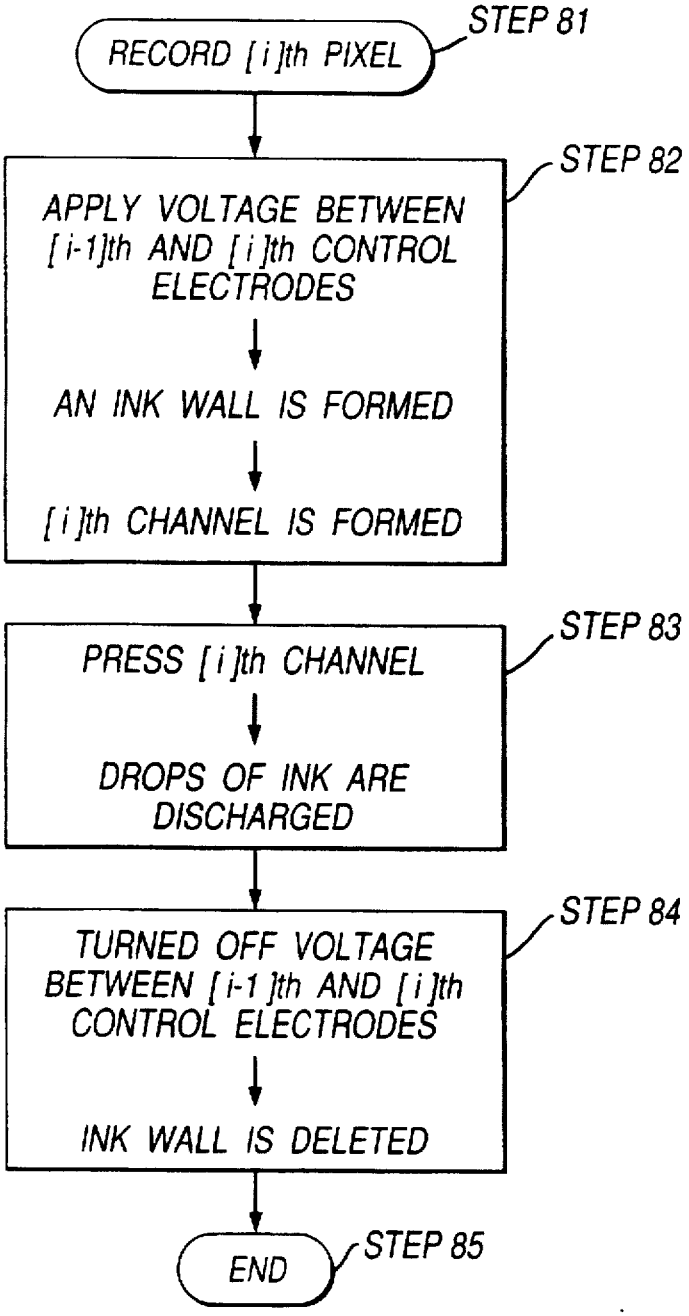
FIG. 8 is a flowchart for explaining the printing operation of the recording head shown in FIG. 7.

When recording the [i]th pixel as shown in FIG. 8, voltage is applied to two sets of the (i−1)th and (i)th higher and lower control electrodes 6A and 6B (Steps 81 and 82). As a result, the ER effect is produced in the ink between the (i−1)th and (i)th control electrodes 1A and 1B and its viscosity becomes much higher than when no voltage is applied. As a result, a wall 13 (viscosity=μ 2; μ 2>μ 1), where μ 2 is the viscosity of the ink when the voltage is applied to the ink, such as μ 2=40 $dP_{axs}$ when the voltage equals 4 kV/mm), of which one end is connected with the channel 9C and the other end leading to the opening, is formed by the ink between the (i−1)th and −(i)th control electrodes 6A and 6B and between flat plates 11A and 11B.

Thus, the [i]th channel 9D is formed. At this time, the piezoelectric element 7 of the record driving unit 4 at the upper stream of the channel 9D is driven corresponding to recording information, and the ink in the corresponding channel 9B in the record driving unit 4 is pressurized. Then, the ink is forced out along the channel formed by the passage wall 8A and the ink wall 13, and drops of ink are discharged from the opening of the [i]th channel (Step 83). After discharging the ink drops 15, the voltage applied to the (i−1)th and (i)th control electrodes 6A and 6B is turned OFF, the ink wall 13 is deleted and the status is restored to the state shown in FIG. 6 (Steps 84 and 85). In this embodiment, it has been so set that viscosity of ink becomes m 1=8 dPa×s when voltage is OFF (E=0 kV/mm) and μ 2=40 dPa× when voltage is ON (E=4 kV/mm).

The recording operations described above are summarized as follows:

1. The [i]th channel 8D is formed by applying voltage to the (i−1)th and the (i)th control electrodes 6A and 6B.

2. Then, the ink drops 15 are discharged by applying pressure to the [i]th channel 9D.

3. The [i]th channel 9D is deleted by turning off the voltage applied to the control electrodes 6A and 6B.

Thus, it is possible to form ink channels dynamically by forming the ink passage walls using the ink itself by changing ink viscosity by selectively driving the control electrodes 6A and 6B (i.e., applying voltage to electrodes 6A and 6B which controls the ink viscosity corresponding to recording pixels). Further, the recording head of the present invention has advantageous features because there is no fixed passage wall in the fluid chamber when there is no printing and the opening is slit shape and extremely wide for pixels. Therefore, the clogging of the opening is rarely caused even when ink is partially dried at the opening and the opening is also rarely affected even when the ink quality is changed.

The recording head described above is manufactured as shown below.

Figure 9A:
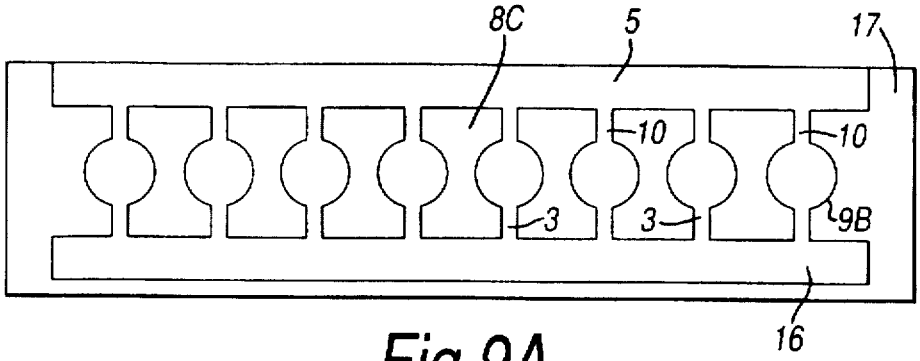
FIG. 9 is a plan view showing the outline of the manufacturing-process of the recording head shown in FIGS. 1, 2 and 3.

As shown in FIG. 9A, a photosensitive glass substrate 17 with an overlying mask pattern is exposed. Glass on the unexposed portion is fused in the developing process to form grooves, and glass on the exposed portion is hardened, not fused and left as it is. By this process, eight 100 μm deep fluid chambers 5, channels 10, the pressure chambers of the record driving unit 4, that is, channels 9B, channels 3 and ink supply chambers 16 are formed. The length between the passage wall end of the fluid chamber 5 to the substrate end is 3 mm and the width of chamber 5 is 100 mm. The channels 10 and 3 are 100 mm wide and 2 mm long. A pressure chamber 9B is in a circular shape 8 mm in diameter. An ink supply chamber 16 is 4 mm long and 100 mm wide.

Figure 9B:
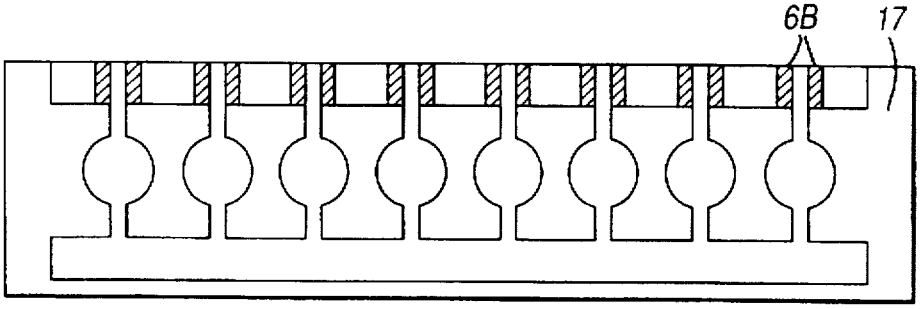

Then, as shown in FIG. 9B, one of the control electrode pair 6A and 6B is formed to extend a passage wall 8C to the end of the fluid chamber 5 of the glass substrate as shown below. That is, a photo resist is applied uniformly after evaporating aluminum uniformly 2 mm thickness over the fluid chamber surface of the substrate 17 shown in FIG. 9A. Then, after positioning a mask pattern shown by the oblique lines in FIG. 9B at the position of the fluid chamber 5 shown in FIG. 9B, it is exposed. After development, the photo resist is removed leaving the oblique lined portion in FIG. 9B. With the photo resist used as a mask, aluminum is fused and removed to form a pattern of the control electrode 6B.

Figure 9C:
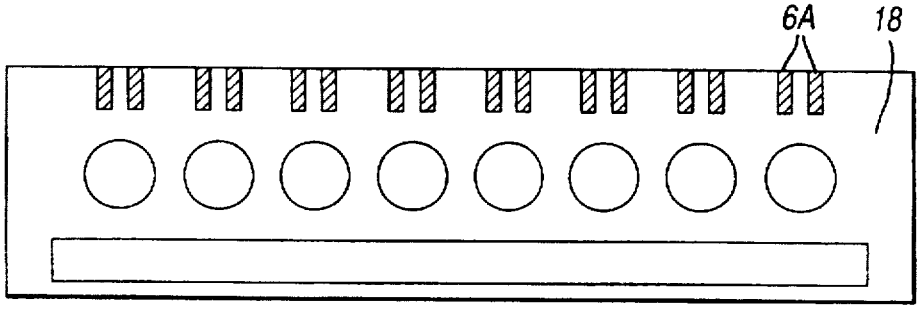
Figure 10:
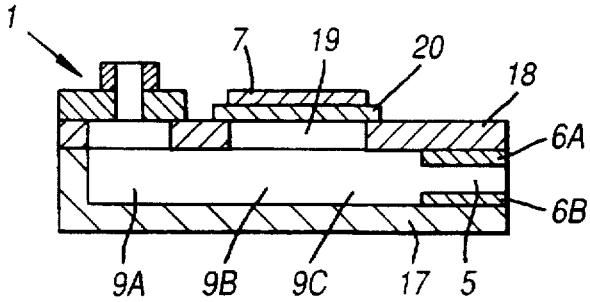
FIG. 10 is a side view showing the outline of the recording head manufactured in the process shown in FIG. 9.

Next, as shown in FIG. 9C, a hole 10 mm in diameter and a 4 mm long and 100 mm wide rectangular hole are machined on another substrate 18. The control electrode 6B is also formed so that it is paired with the electrode 6B that has been formed in the above process on this substrate 18 to fit the position of the previously formed electrode pattern. A piezoelectric element 7 is adhered to the substrate 17 to cover an opening 19 shown in FIG. 10. The piezoelectric element 7 has been formed with electrodes provided on the upper and lower surfaces of a 8 mm in diameter and 0.5 mm thick piezoelectric ceramic element and is adhered on a stainless steel disc 20 with a conductive bonding agent so that it becomes concentric with a 12 mm in diameter and 0.2 mm thick stainless steel disc 20. The substrate 18 is pasted to the substrate 17 shown in FIG. 9B by properly positioning. The stainless steel disc 20 of each piezoelectric element 7 is electrically earthed and the electrodes on the surface without the piezoelectric element 7 adhered are connected to a piezoelectric element driving circuit (not shown). Further, an ink supply port 1 is mounted to the ceiling of the ink supply chamber. The recording head is now completed.

Next, a recording apparatus with the recording head shown in FIGS. 1, 2 and 3 incorporated will be explained with reference to FIG. 11.

Figure 11:
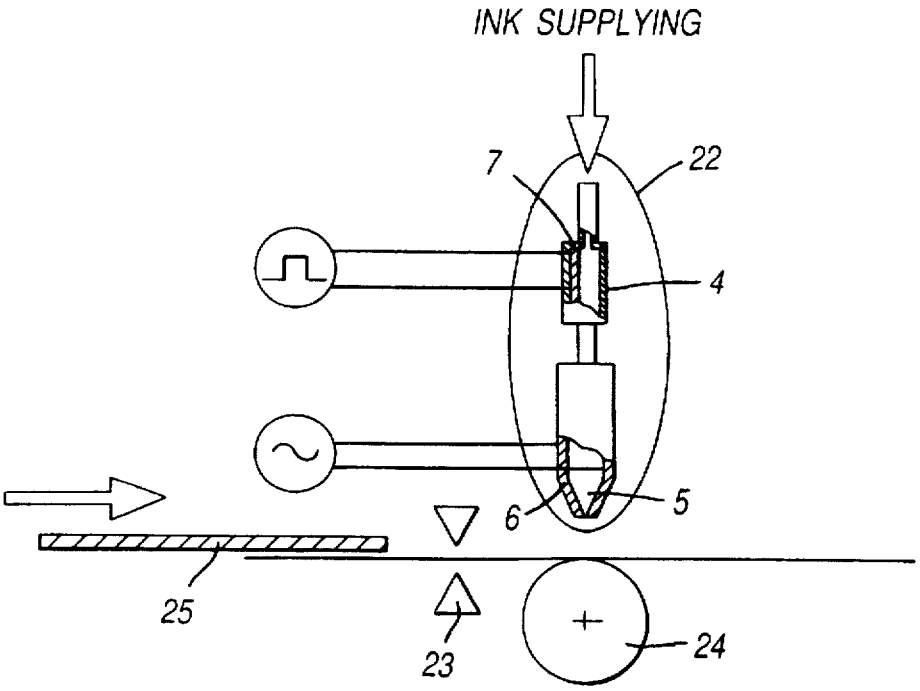
FIG. 11 is a schematic diagram showing a recording 7 apparatus incorporating the recording head shown in FIG. 1.

As shown in FIG. 11, the recording apparatus is comprised of a recording head 22, a sensor 23, a platen roller 24 and a piezoelectric element driving control unit (not shown) shown in FIG. 1. When a recording medium 25 such as paper and the like is set from the left in FIG. 11, it is detected by the sensor 23. When the recording medium 25 is carried by the platen roller 24, the recording head 22 is driven and an image is recorded on the recording medium 25.

Figure 12:
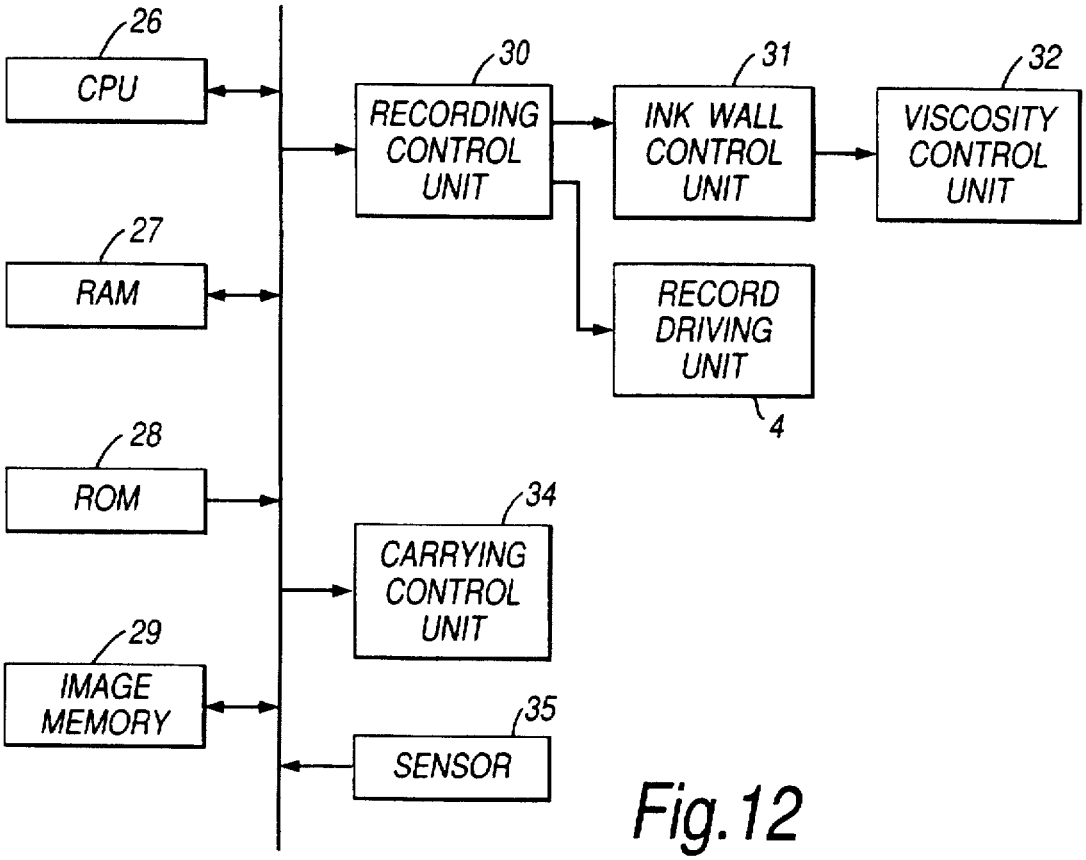
FIG. 12 is a block diagram showing the outline of the control unit of the recording apparatus shown in FIG. 11.

In FIG. 12, the structure of a control unit which controls the recording apparatus shown in FIG. 11 is shown. As shown in FIG. 12, this control unit is comprised of a CPU 26, a RAM 27, a ROM 28, an image memory 29, a recording control unit 30, an ink wall control unit 31, a viscosity control unit 32, a record driving unit 4, a carrying control unit 34 and a sensor 35. The CPU 26 controls the entire control unit. The RAM 27 is used for a working area and the like. The ROM 28 stores a control program, data and the like. Record images transferred from the outside are stored in the image memory 29. The recording control unit 30 executes the overall control for recording. The ink wall control unit 31 controls the ink wall formation and deletion and pressure in the fluid chamber 5. The viscosity control unit 32 applies driving voltage to the control electrodes 6A and 6B according to a signal from the ink wall control unit 31. The record driving unit 4 controls application of voltage to the piezoelectric element 7 which generates a driving force to discharge drops of ink. The carrying control unit 34 controls the carry of a recording medium. The sensor 35 detects the position of the recording medium 25.

The operation of the recording apparatus shown in FIG. 12 will be explained referring to the drive timing chart in the recording operation shown in FIGS. 13 and 14. Further, FIGS. 13 and 14 show different operating modes.

Figure 13:
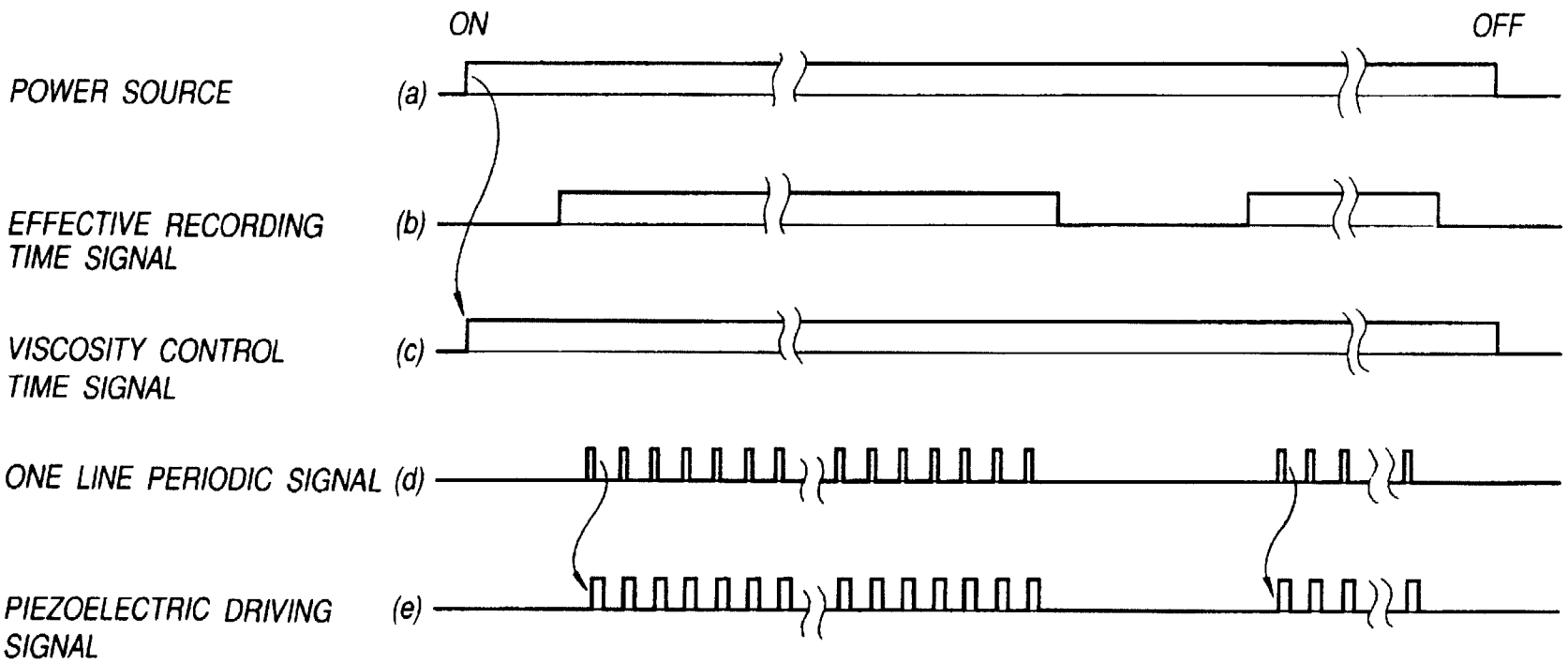
FIG. 13 is a timing chart showing one example of the drive timing at each part of the control unit shown in FIG. 12 during the recording operation.
Figure 14:
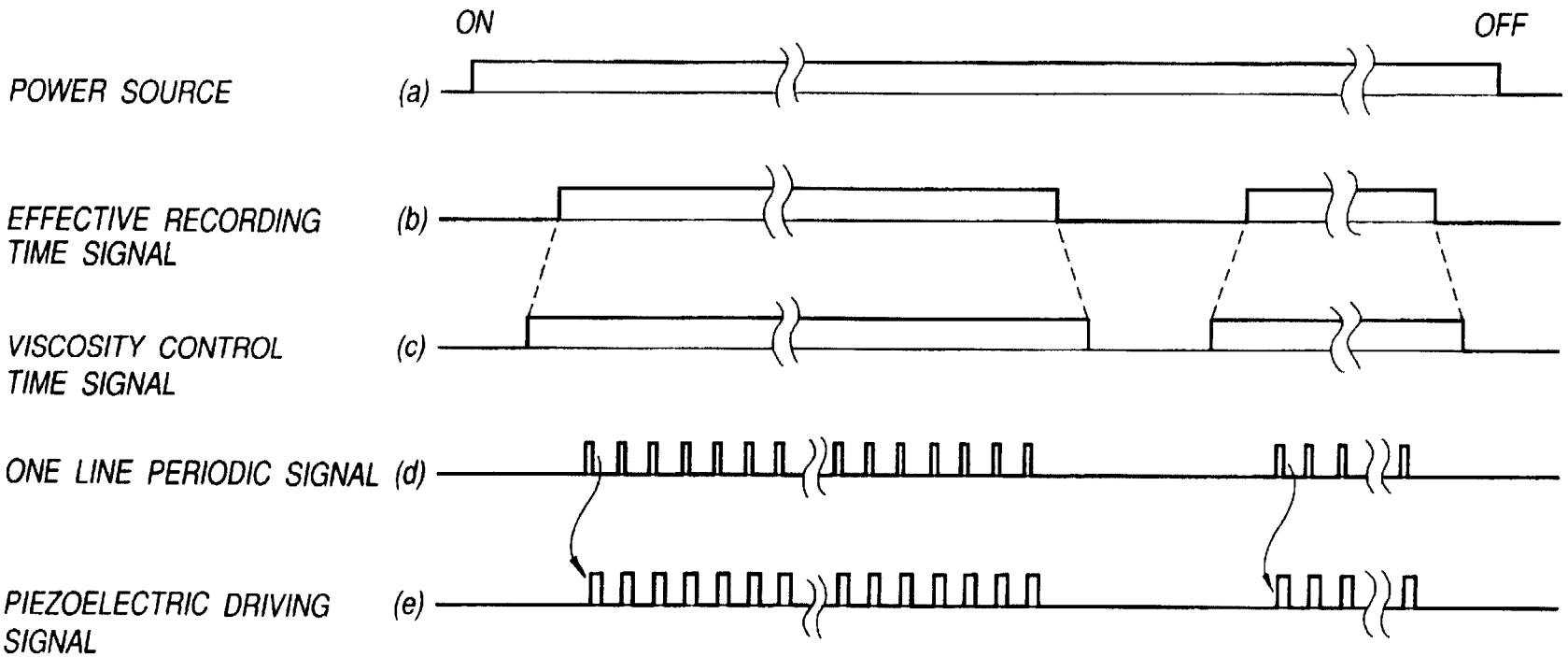
FIG. 14 is a timing chart showing another example of the drive timing at each part of the control unit shown in FIG. 12 during the recording operation.

FIG. 13 shows Operating Mode A. As shown in FIG. 13(*a*), when the power source of the recording apparatus is turned ON, the record control unit 30 operates and a viscosity control time signal shown in FIG. 13(*c*) is supplied to the viscosity control unit 32. As a result, voltage is applied to a pair of the control electrodes 6A and 6B of the recording head and the channel 9D corresponding to recording pixels is formed by the operation as described above. When the setting of the recording medium 25 in the recording apparatus is detected by the sensor 35, an effective recording time signal shown in FIG. 13(*b*) is supplied to the recording control unit 30. The period for supplying this effective recording time signal indicates a recording time from when setting the recording medium 25 in the recording apparatus and starting the recording to the end of the recording. In response to the one line periodic signal generated in the record control unit 30 as shown in FIG. 13(*d*), a piezoelectric driving signal is supplied to the piezoelectric element 7 from the record driving unit 33 as shown in FIG. 13(*e*) and an image is recorded one line at a time. Even after all recordings are completed, the viscosity control time signal shown in FIG. 13(*c*) remains unchanged and the ink walls are held in the recording head as long as the power source of the recording apparatus is ON. When the power source of the recording apparatus is turned OFF, the viscosity control time signal is turned OFF accordingly and the ink walls in the recording head vanish.

Next, the recording operation in Mode B shown in FIG. 14 will be explained. This Mode B differs from Mode A in the handling of the viscosity control time signal. While the viscosity control is executed in response to ON/OFF of the power source of the recording apparatus in Mode A, the viscosity control is executed linking with an effective recording time in Mode B. As show in FIG. 14(*a*), even when the power source of the recording apparatus is turned ON, the viscosity control time signal shown in FIG. 14(*c*) remains unchanged. When the setting of a recording medium in the recording apparatus is confirmed by the detection signal from the sensor 35, a record approving signal is supplied to the record control unit 30 that will be described later. The record control unit 30 forms a channel by the ink walls by turning the viscosity control time signal ON before starting the actual recording as shown in FIG. 14(*c*). Thereafter, a piezoelectric driving signal is generated as shown in FIG. 14(*e*) in response to the one line periodic signal shown in FIG. 14(*d*) while the effective recording time signal is turned ON and the recording is carried out. After completing the recording, the viscosity control time signal is turned OFF, the ink walls vanish and the apparatus is reset to the initial state.

When carrying out the recording in Mode A, the viscosity control time signal is switched only once and, therefore, the record control circuit can be made simple. On the other hand, voltage is constantly applied to the ink (i.e., the electric viscous fluid) and, therefore, the record control circuit deteriorates faster than if the voltage were applied intermittently. In contrast, when carrying out the recording in Mode B, the viscosity control signal is frequently switched and the record control circuit will become somewhat complicated. However, voltage is not applied to the ink during the time there is no recording, even when the power source of the recording apparatus is ON, which suppresses deterioration of the record control circuit.

The recording operation in Mode B will be explained referring to FIGS. 14 and 12.

The CPU 26 reads a control program and control data any time from the ROM 28 and executes the control program. First, channels are formed in the recording head when the sensor 35 detects that a recording medium has been set in the prescribed location.

A channel forming signal-is sent from the CPU 26 through the record control unit 30 to the ink wall control unit 31. The ink wall control unit 31 sends a control signal to the viscosity control unit 32. The viscosity control unit 32 generates voltage to be applied to the control electrodes 6A and 6B according to the method described later and forms channels by driving the control electrodes 6A and 6B.

The CPU 26 reads record data for one line out of the image memory 29 and sends the data to the record control unit 30. The record control unit 30 sends pixel data to be recorded and one line periodic signal to the record driving unit 4. The record driving unit 4 discharges drops of ink by driving the piezoelectric element 7 of the channel 9D corresponding to recording pixels synchronous with one line recording period. When completing the recording of one line of data, data of the next line is read and thereafter, by repeating the same operation, an image is formed.

When the recording of all data is completed, the CPU 26 sends a channel erase signal to the ink wall control unit 31 through the record control unit 30. The ink wall control unit 31 sends a control signal to the viscosity control unit 32. The viscosity control unit 32 erases the channels in the recording head by turning the driving voltage OFF.

Next, when the recording medium 25 is carried into the recording apparatus, the operational steps are repeated starting from channel creation by the recording head. As to the recording operation in Mode A, the operations are entirely the same as those described above except that channel formation by the recording head is executed when the power source of the recording apparatus is turned ON and the channels are deleted when the power source is turned OFF.

Figure 15:
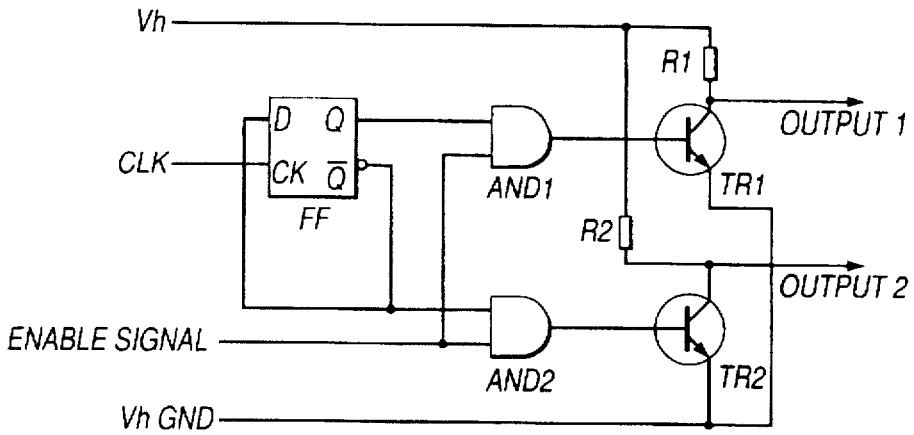
FIG. 15 is a circuit diagram showing the outline of the voltage application circuit to apply voltage to control electrodes of the viscosity control unit shown in FIG. 12.
Figure 16:
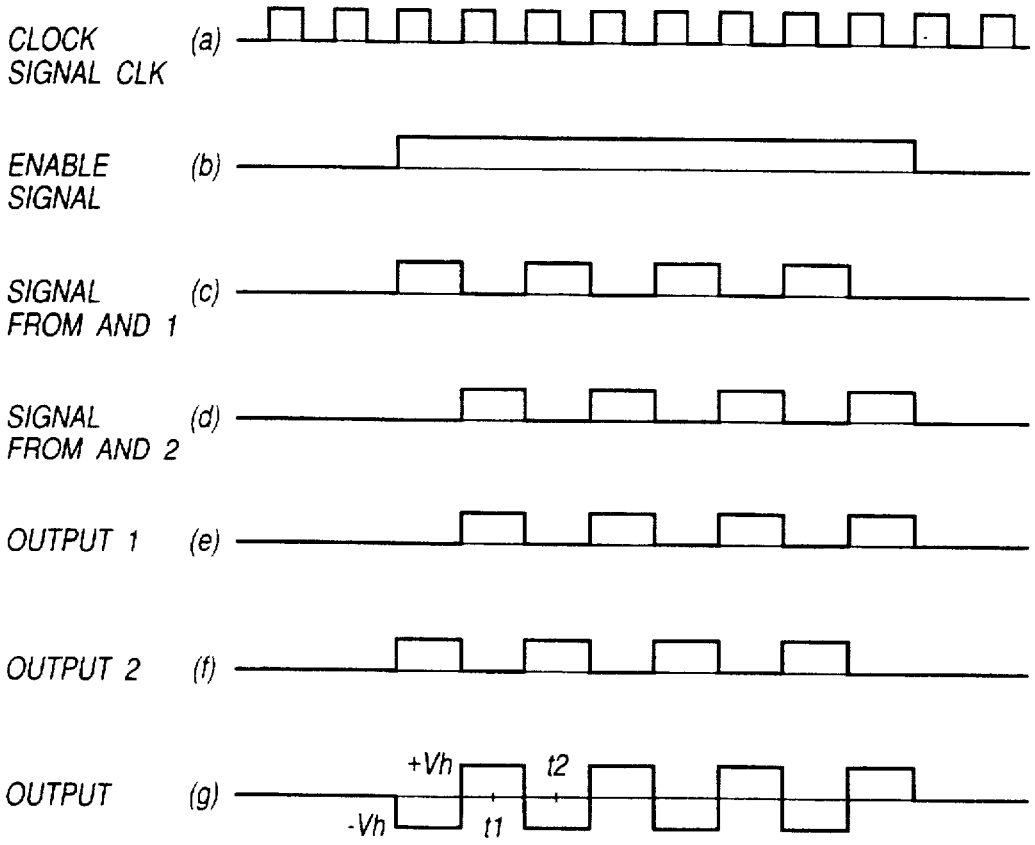
FIG. 16 is a waveform diagram showing the signal waveforms in the circuit shown in FIG. 15.

An example of the circuit for applying voltage to the control electrodes 6A and 6B is shown in FIG. 15 and a timing chart of the operation of this circuit is shown in FIG. 16. In the circuit shown in FIG. 15, Vh denotes a voltage source (+100 V) of high voltage to be applied to the control electrodes 6A and 6B. VhGND denotes ground voltage. Between the voltage source Vh and the ground voltage VhGND, a resistor R1 and a series circuit of collector and emitter of a transistor TR1 are connected and also, a resistor R2 and a series circuit of collector and emitter of a transistor TR2 are connected. The output sides of AND circuits AND1 and AND2 are connected to the bases of the transistors TR1 and TR2, respectively. To the input sides of these AND circuits AND1 and AND2, an Enable signal is input as well as a set Q output and a reset $\overline{Q}$ output of a flip-flop FF. Further, to the CK terminal at the input side of the flip-flop FF, a clock signal CLK is input and a reset output $\overline{Q}$ is input to the D terminal. Here, the clock CLK is a fundamental clock of this circuit as shown in FIG. 16(*a*). The Enable signal is a control signal to apply voltage to the control electrodes 1A and 1B as shown in FIG. 16(*b*) and corresponds to the viscosity control time signal as shown in FIGS. 13(*c*) and 14(*c*).

The clock signal CLK shown in FIG. 16(*a*) is input to the flip-flop FF as shown in FIG. 15. At the leading edge of the clock signal CLK, the set output signal is input to the AND circuit AND1 from the set output terminal Q of the flip-flop FF and the reset output signal is input to the AND circuit AND2 from the reset output terminal Q. Here, when the Enable signal shown in FIG. 16(*b*) has been input to the AND circuits AND1 and AND2, output signals shown in FIGS. 16(*c*) and 16(*d*) are supplied to the transistors TR1 and TR2 from the AND circuits AND1 and AND2, respectively. Therefore, from these voltage application circuits, output signals OUTPUT1 and OUTPUT2 are output. These output signals OUTPUT1 and OUTPUT2 repeat H and L levels as shown in FIG. 16(*e*) and 16(*f*), respectively, and they are a half period out of phase from each other. Accordingly, a potential difference between the output signals OUTPUT1 and OUTPUT2 will become an output signal OUTPUT shown in FIG. 16(*g*) and becomes a rectangular wave which alternately repeats voltage +Vh and voltage −Vh.

Figure 17A:
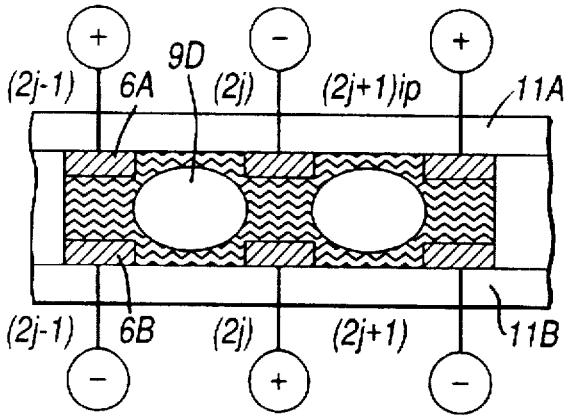
FIG. 17 is an outline diagram for explaining the voltage application system to the control electrodes in the recording apparatus of the present invention.
Figure 17B:
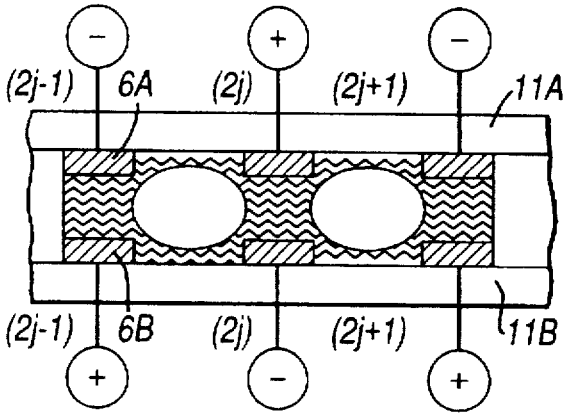
Figure 17C:
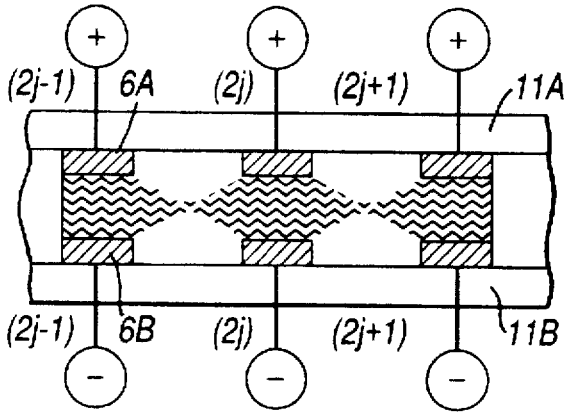

The output signal OUTPUT1 shown in FIG. 16(*e*) is supplied to the even-numbered control electrode provided on the lower side flat plate 11B and the odd-numbered control electrode provided on the upper side flat plate 11A. When the output signal OUTPUT2 is supplied to the odd-numbered control electrode 6B provided on the lower side flat plate 11B and the even-numbered control electrode 6A provided on the upper side flat plate 11A, the viscosity distribution in the recording head is changed as shown in FIG. 17. FIG. 17A shows the viscosity distribution when t=t1 on the timing chart shown in FIG. 16, while FIG. 17B shows the viscosity distribution when t=t2 on the timing chart shown in FIG. 16. Further, FIG. 17C shows the viscosity distribution when negative voltage is applied to the control electrode 6B provided on the lower side flat plate 11B and positive voltage to the control electrode 6A provided on the upper side flat plate 11A. (2j) [j2≧1] of the control electrodes 6A and 6B denotes the even-numbered control electrodes and (2j−1), (2j+1) [j≧1] denote the odd-numbered control electrodes.

In the recording head of the present invention, output signal is applied to the control electrodes 6A and 6B so that its polarity becomes different at their upper-and lower, and the left and right sides as shown in FIG. 17A. The output signal OUTPUT1 shown in FIG.-16(*e*) is applied to the (2j)th lower side control electrode 6B and the (2j+1)th upper side control electrode 6A and the output signal OUTPUT2 shown in FIG. 16(*f*) is applied to the (2j)th upper side control electrode 6A and the (2j+1)th lower side control electrode 6B. When voltage is applied to the control electrodes 6A and 6B as described above, the ER ink viscosity distribution will become as shown in FIG. 17A. As a result of such the viscosity distribution as this, the viscosity becomes low at the center of the channel and high around the center and this central portion is defined by the channel. As a pressure is applied impulsively to ink in this defined channel, it becomes possible to discharge drops of ink 15. When a time t=t2 as shown in FIG. 16, a voltage signal is applied and a channel is formed as shown in FIG. 17B.

However, in a recording head without the system of the present invention applied, for instance, when (+) voltage is applied to the upper side electrode and (−) voltage to the lower side electrode as shown in FIG. 17C, a potential difference is produced between the (2j)th lower side control electrode 6B and the (2j+1)th upper side control electrode 6A, and the (2j)th upper side control electrode 6A and the (2j+1)th lower side control electrode 6B. As a result, in the case of a high resolution recording head where the space between electrodes is narrow, cross-talk is caused between adjacent electrodes, the ink viscosity becomes high at the channel center and it becomes hard to satisfactorily discharge drops of ink.

Figure 18A:
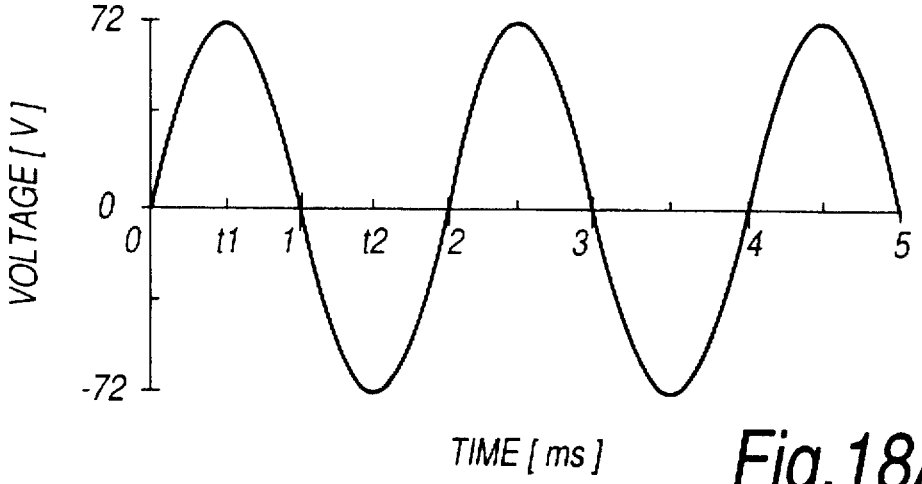
FIG. 18 is a waveform diagram showing an AC voltage waveforms applied to the control electrodes in one embodiment of the recording apparatus of the present invention.
Figure 18B:
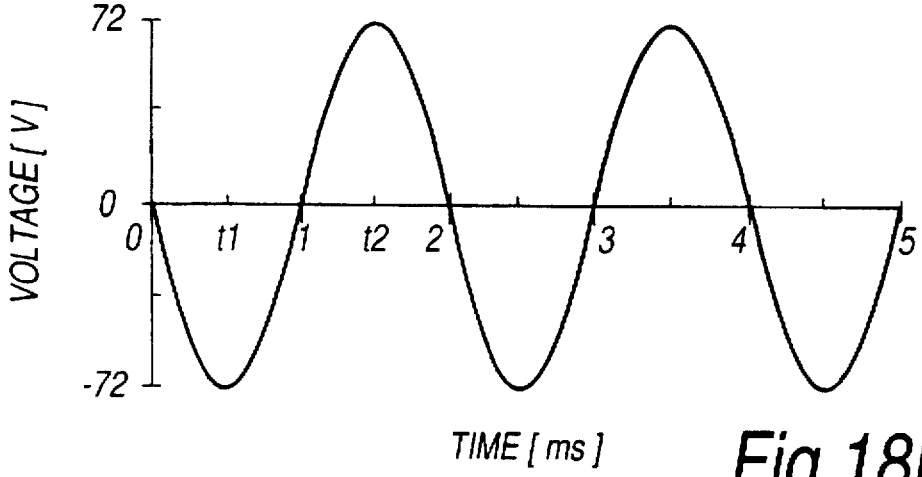

Next, the system to apply an alternating current (AC) driving signal to the control electrodes 6A and 6B will be explained referring to FIGS. 18A and 18*b*. In this embodiment, AC at 50 V, 500 Hz is used for AC driving signal. The AC driving signal shown in FIG. 18A and that shown in FIG. 18B are out of phase by π. The AC driving signal shown in FIG. 18A is applied to the (2j)th lower side control electrode 6B and the (2j+1)th upper side control electrode 6A and the AC driving signal shown in FIG. 18B is applied to the (2j)th upper side control electrode 6A and the (2j+1)th lower side control electrode 6B. At the peak, a potential difference of approximately 100 V is produced between the upper and lower, and left and right control electrodes 6A and 6B as shown in FIG. 19A, and the viscosity distribution in the recording head will become as shown in FIGS. 17A and 17B.

Figure 19A:
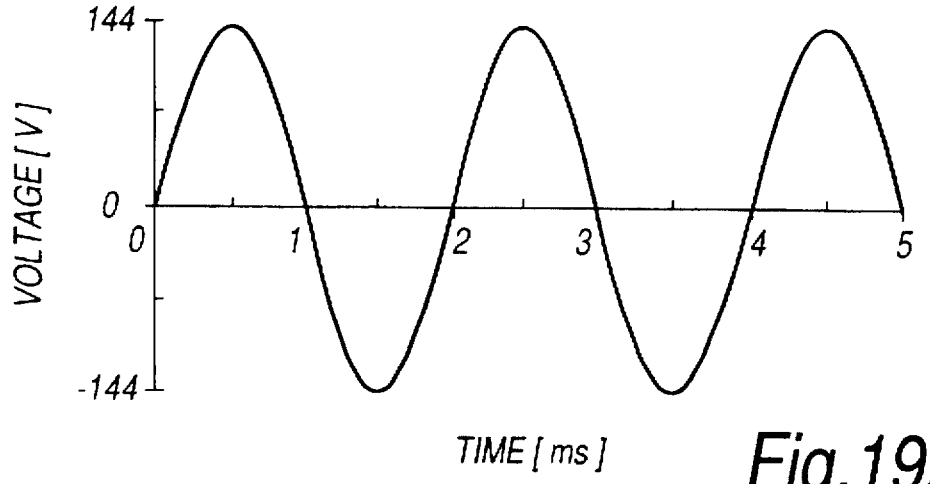
FIG. 19 is a waveform diagram for explaining the viscosity control of the recording apparatus and the piezoelectric element drive timing in one embodiment of the recording apparatus of the present invention.
Figure 19B:
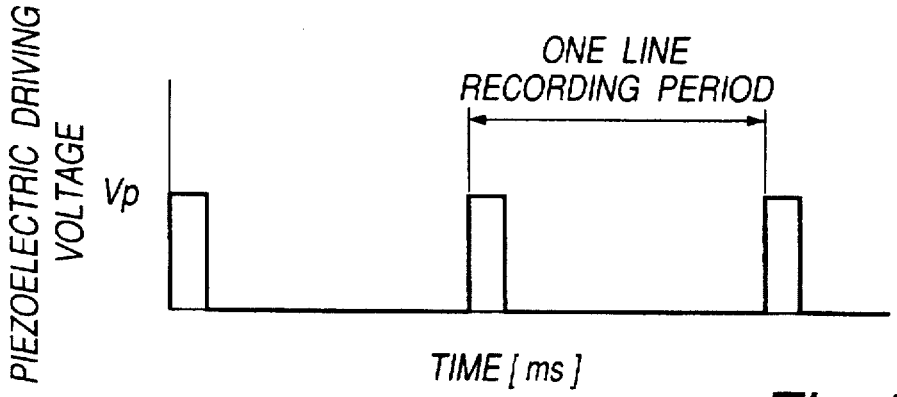

FIG. 19B shows the piezoelectric element drive timing to discharge drops of ink when voltage is applied to the viscous control electrodes shown in FIG. 19A. Here, FIG. 19A shows a time change of voltage between the (2j)th upper side control electrode 6A and the (2j)th lower side control electrode 6B in the viscosity distribution shown in FIG. 17A. FIGURE 19B shows a timing for driving the piezoelectric element 7. As shown in FIG. 19A, voltage between the control electrodes 6A and 6B is synchronized with one line recording period of recording pixels. In this embodiment, at the time of 0 voltage when voltage between the control electrodes 6A and 6B changes from (−) to (+), driving voltage is applied to the piezoelectric element 7.

Figure 20A:
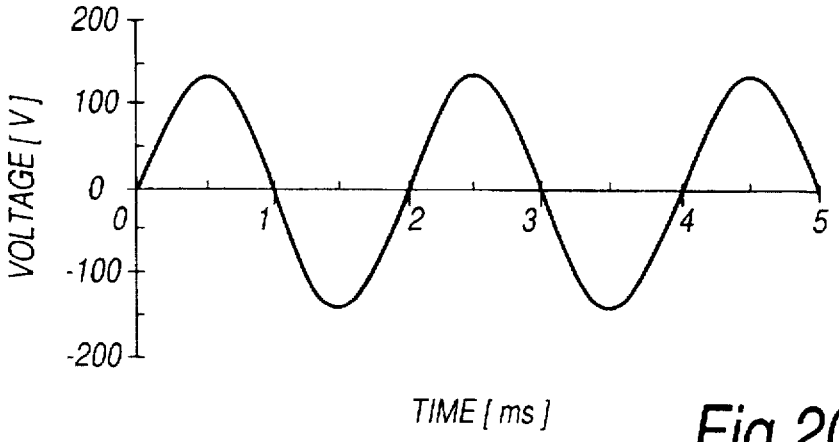
FIG. 20 is a waveform diagram for explaining out of phase voltages applied to the control electrodes in one embodiment of the recording apparatus of the present invention.
Figure 20B:
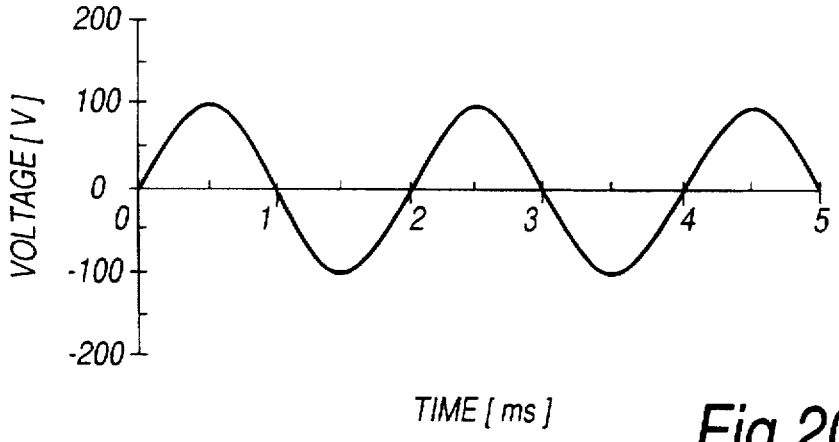
Figure 20C:
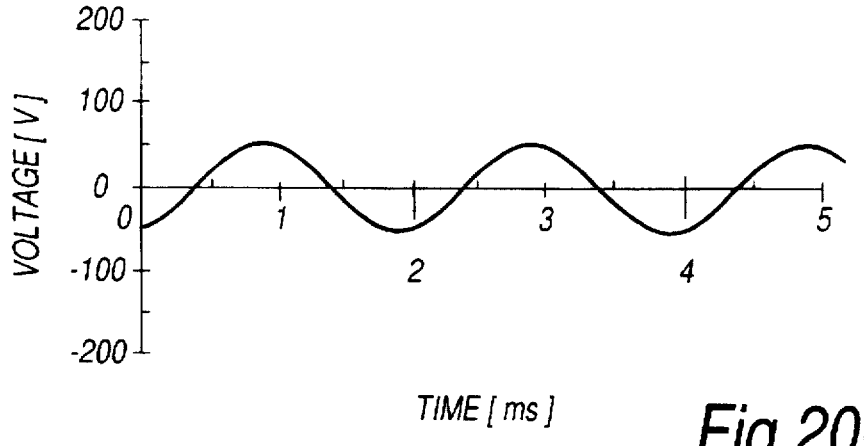

Referring to FIGS. 20A, 20B and 20C, the effect of out of phase when AC driving signal is applied between the control electrodes 6A and 6B will be explained. FIGS. 20A, 20B and 20C show the time changes of voltage between the (2j)th upper side control electrode 6A and the (2j)th lower side control electrode 6B in the viscosity distribution shown in FIG. 17A. Further, the time changes shown in these FIGS. 20A, 20B and 20C are equal to the time changes of voltage between the (2j)th upper side control electrode 6A and the (2j+1)th upper side control electrode 6A shown in FIG. 19A. FIG. 20A shows a voltage difference when voltage applied between the control electrodes 6A and 6B became out of phase by π. FIG. 20B shows a voltage difference when voltage applied between the control electrodes 6A and 6B became out of phase by π/2, and FIG. 20C shows a voltage difference when voltage applied between the control electrodes 6A and 6B became out of phase by π/4, respectively. From these FIGS. 20A, 20B and 20C, it is seen that maximum voltage will drop with the out of phase becoming small from π to π/2 and to π/4. Therefore, the desirable effective range for out of phase is π/2 to π.

When the voltage application system of the present invention is used, as polarities of voltage applied to adjacent control electrodes and opposing control to electrodes are not constant, polarization of dispersion particles by electrophoresis or their adhesion to electrodes are hard to occur. Accordingly, it is possible to prevent electric viscous fluid from being deteriorated and no cross-talk is generated.

In this invention, ink channels are dynamically formed by forming the ink walls using the ink itself while changing viscosity of ink by selectively driving electrodes corresponding to recording pixels. That is, when the printing is not carried out, there is no nozzle in the fluid chamber and the opening is formed in the extremely wide slit shape corresponding to pixels. Therefore, even when ink is partially dried up at the ink discharging port, the discharging port is rarely clogged or affected by ink when its quality is changed as a result of dry-up.

When the voltage application system of the present invention is used, polarities of voltage applied to adjacent and opposing control electrodes are not constant and polarization of dispersion particles by electrophoresis and their adhesion to electrodes rarely occur. Therefore, it is possible to prevent electric viscous fluid from being deteriorated. Further, as the ink channels can be prevented from becoming highly viscous by cross-talk, it is also possible to achieve a recording head of high resolution.

What is claimed is:

1. An ink jet recording apparatus comprising:

a housing containing ink and having an opening through which the ink discharges, the ink including fine particles;

ink wall forming means for forming a plurality of ink walls in the ink, said ink walls constituting respective portions of the ink and fine particles, by applying an electric field to the respective portions of the ink to cause the fine particles in the respective portions of the ink to line-up; and means for discharging remaining ink that lies between the ink walls when the ink walls are formed.

2. An ink jet recording apparatus comprising:

a housing containing ink and having an opening through which the ink discharges, the ink having an apparent viscosity which is changeable by receiving an electric field;

a plurality of paired electrodes arranged in the housing, each one of said paired electrodes having a first electrode and a second electrode disposed so that the first electrode opposes the second electrode;

voltage applying means for applying a voltage to the paired electrodes to form a plurality of ink walls by generating prescribed electric fields between each one of said paired electrodes and by increasing the apparent viscosity of the ink between each one of said paired electrodes; and means for discharging the ink that has not been subjected to an increase in the apparent viscosity from the opening and between the ink walls.

3. The ink jet recording apparatus according to claim 2 further comprising:

means for supplying the ink to the housing.

4. The ink jet recording apparatus according to claim 2, wherein:

the paired electrodes are arranged along a direction perpendicular to a direction that the ink discharges.

5. The ink jet recording apparatus according to claim 2, wherein:

the paired electrodes are arranged through a space corresponding to a size of one pixel.

6. The ink jet recording apparatus according to claim 2, wherein:

the voltage applying means includes a first voltage applying means for applying a first voltage with a prescribed polarity to one of the paired electrodes; and a second voltage applying means for applying a second voltage, with a polarity opposite to the prescribed polarity, to another one of the paired electrodes that is adjacent to said one of the paired electrodes.

7. The ink jet recording apparatus according to claim 2, wherein:

the voltage applying means includes a first AC voltage applying means for applying a first AC voltage to one of the paired electrodes; and a second AC voltage applying means for applying a second AC voltage to another one of the paired electrodes that is adjacent to said one of the paired electrode, the second AC voltage having a phase within a range from $\mu/2$ to $\mu$ with respect to a phase of the first AC voltage.

8. An ink jet recording apparatus comprising:

a housing containing ink and having an opening through which the ink discharges, the ink having a viscosity which is changeable by receiving an electric field;

a first paired electrodes and a second paired electrodes arranged in the housing, the second paired electrodes being adjacent to the first paired electrodes, each of said first paired electrodes and second paired electrodes having a first electrode and a second electrode disposed so that the first electrode opposes the second electrode;

means for applying a voltage to the first paired electrodes and the second paired electrodes to form a plurality of ink walls of the ink therebetween by generating a first electric field between the first paired electrodes and a second electric field between the second paired electrodes, a direction of the first electric field being different from a direction of the second electric field; and means for discharging the ink not presiding between the first paired electrodes and the second paired electrodes from the opening between the ink walls.

9. An ink jet recording method comprising the steps of:

applying a voltage to form a plurality of electric fields between a plurality of electrode pairs arranged in an ink chamber containing ink, the ink having an apparent viscosity which is changeable by receiving an electric field;

forming ink walls between each one of said electrode pairs of the ink therebetween in response to said electric fields by increasing the apparent viscosity of the ink, thus forming a plurality of ink flow channels through which the ink flows; and selectively discharging the ink, that is not used to form the ink walls, from the ink flow channels and out of the ink chamber based on recording information.

10. The ink jet recording method according to claim 9, wherein the applying step further comprises:

forming a direction of one of the electric fields different from a direction of another one of the electric fields that is adjacent to said one of the electric fields.

11. An ink jet recording apparatus comprising:

a housing having a first surface and a second surface opposing each other and containing ink, the ink having an apparent viscosity which is changeable by receiving an electric field;

a first plurality of electrodes provided on the first surface of said housing;

a second plurality of electrodes provided on the second surface of said housing, said second electrodes opposing said first electrodes to constitute a plurality of paired electrodes with said first electrodes;

voltage applying means for applying a voltage to the paired electrodes to form a plurality of ink walls by generating prescribed electric fields between each one of the paired electrodes and by increasing the apparent viscosity of the ink between each one of the paired electrodes, the ink walls constituting therebetween a plurality of channels with the first surface and the second surface of said housing; and means for discharging the ink that is not used to form the ink walls and that is passing through the channels.

12. The ink jet recording apparatus according to claim 11, wherein:

said first electrodes and said second electrodes are arranged along a direction perpendicular to a direction that the ink discharges at a prescribed interval.

13. An ink jet recording apparatus comprising:

a housing including a first flat plate and a second flat plate opposing each other and containing ink, the ink having an apparent viscosity which is changeable by receiving an electric field;

a first plurality of electrodes provided on the first flat plate of said housing;

a second plurality of electrodes provided on the second flat plate of said housing, said second electrodes opposing said first electrodes to constitute a plurality of paired electrodes with said first electrodes;

voltage applying means for applying a voltage to the paired electrodes to form a plurality of ink walls by generating prescribed electric fields between each one of the paired electrodes and by increasing the apparent viscosity of the ink between each one of the paired electrodes, the ink walls constituting therebetween a plurality of channels with the first flat plate and the second flat plate of said housing; and means for discharging the ink that is not used to form the ink walls and that is passing through the channels.

14. The ink jet recording apparatus according to claim 13, wherein:

said first electrodes and said second electrodes are arranged along a direction perpendicular to a direction that the ink discharges at a prescribed interval.

15. An ink jet recording apparatus according to claim 13, wherein:

the voltage applying means includes first AC voltage applying means for applying a first AC voltage to one of the paired electrodes; and second AC voltage applying means for applying a second AC voltage to another one of the paired electrodes that is adjacent to the one of the paired electrodes, the second AC voltage having a different phase with respect to a phase of the first AC voltage.

* * * * *